US006874191B2

(12) United States Patent
Kim et al.

(10) Patent No.: US 6,874,191 B2
(45) Date of Patent: Apr. 5, 2005

(54) WASHING MACHINE AND CONTROLLING METHOD THEREOF

(75) Inventors: Hyun-sook Kim, Seoul (KR); Hyung-kyoon Kim, Suwon (KR); Sang-yeon Pyo, Suwon (KR); Chan-woo Park, Anyang (KR); Joon-yeop Lee, Suwon (KR); Seon-woo Park, Suwon (KR); Sang-yong Shim, Seoul (KR); Sang-wook Kang, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/878,015

(22) Filed: Jun. 29, 2004

(65) Prior Publication Data

US 2004/0231708 A1 Nov. 25, 2004

Related U.S. Application Data

(62) Division of application No. 09/918,552, filed on Aug. 1, 2001, now Pat. No. 6,789,404.

(30) Foreign Application Priority Data

Sep. 20, 2000 (KR) ..... 2000-55266
Feb. 26, 2001 (KR) ..... 2001-9678

(51) Int. Cl.[7] ..... D06F 17/00
(52) U.S. Cl. ..... 8/158
(58) Field of Search ..... 8/158–159; 68/186, 68/187, 196

(56) References Cited

U.S. PATENT DOCUMENTS

| | | | | | |
|---|---|---|---|---|---|
| 685,910 | A | | 11/1901 | Keukelaere | |
| 955,993 | A | | 4/1910 | Psarski | |
| 1,000,251 | A | | 8/1911 | Frusher et al. | |
| 1,349,545 | A | * | 8/1920 | Bak | 68/194 |
| 1,655,250 | A | * | 1/1928 | Smith | 68/197 |
| 2,314,962 | A | | 3/1943 | Wood | |
| 2,651,932 | A | | 9/1953 | Drum et al. | |
| 3,927,972 | A | | 12/1975 | Kawamura et al. | |
| 4,103,523 | A | | 8/1978 | Plack | |
| 4,231,236 | A | | 11/1980 | Tratta et al. | |
| 5,263,343 | A | | 11/1993 | Lee | |
| 5,603,233 | A | | 2/1997 | Erickson et al. | |
| 5,960,804 | A | | 10/1999 | Cooper et al. | |

* cited by examiner

*Primary Examiner*—Frankie L. Stinson
*Assistant Examiner*—Joseph L. Perrin
(74) *Attorney, Agent, or Firm*—Robert E. Bushnell, Esq.

(57) ABSTRACT

Disclosed is a washing machine comprising a heating tank accommodating the washing and washing water; a heating part heating the washing water in the heating tank; and a circulation pump circulating the washing water in the heating tank. With this configuration, the present invention provides the circulation pump circulating washing water in the heating tank, thereby preventing the washing from oxidizing, improving a washing efficiency especially improving a washing efficiency according to washing material, and saving washing water. Further, water supply and drain can be easily performed.

6 Claims, 8 Drawing Sheets

WASHING MACHINE AND CONTROLLING METHOD THEREOF

CROSS-REFERENCE TO RELATED APPLICATIONS

This application is a divisional of applicant's Ser. No. 09/918,552 filed in the U.S. Patent & Trademark Office on 1 Aug. 2001 now U.S. Pat. No. 6,789,404, and assigned to the assignee of the present invention.

CLAIM OF PRIORITY

This application makes reference to, incorporates the same herein, and claims all benefits accruing under 35 U.S.C. §119 and §120 from my application entitled WATER CYCLE APPARATUS OF BOILING MACHINE filed with the Korean Industrial Property Office on 20 Sep. 2000 and there duly assigned Ser. No. 2000/55266 and my application entitled WASHING MACHINE AND CONTROLLING METHOD THEREOF filed with the Korean Industrial Property Office on 26 Feb. 2001 and there duly assigned Ser. No. 2001/9678.

BACKGROUND OF THE INVENTION

1. Field of the Invention

The present invention relates in general to a washing machine and a control method thereof, and more particularly, to a washing machine and a control method thereof, which are improved in circulation mechanism of washing water.

2. Description of the Related Art

Recently, various washing machines have spread to a household according to the developments of washing technology such as a washing by means of air bubbles, a washing by striking the laundry with washing water, etc. Thus, the time and labor required for washing is greatly saved.

Nevertheless, there is a shortcoming that dirt is not completely removed in the case of washing white clothes. Moreover, in the case of washing underwears or baby clothes, a user wants not only a washing but also a bleaching and sterilization. Also, it is necessary to boil underwears contacting with a human body, because of an environmental contamination.

As shown in FIG. 8, a conventional washing machine having a boiling function is comprised of a cabinet 110 having a top opening 112 through which the laundry and a detergent are received; and a cover 114 opening and closing the top opening 112.

The cover 114 is comprised of an inside cover 116 for covering a heating tank 140 and an outside cover 122 above the inside cover 116.

Outside the cabinet 110 are installed a selection button 136 allowing a user to control to machine and a power controller 132 controlling a heater 150 according to a temperature signal from a temperature sensor 152.

Inside the cabinet 110 is provided the heating tank 140, being separated from the cabinet 110 by a predetermined distance, accommodating the washing and the detergent.

In the lower part of the heating tank 140 is installed the heater 150 boiling the washing by heating washing water. One side of the heater 150 is provided the temperature sensor 152 sensing a washing water temperature in the heating tank 140 heated by the heater 150. Above the heater 150 is horizontally provided a blocking plate 154 preventing the washing in the heating tank 140 from contacting with the heater 150. The blocking plate 154 has a plurality of holes 156 through which washing water flows.

With this configuration, in the conventional washing machine having the boiling function, a user puts washing water in the heating tank 140 with the washing and the detergent, and closes the inside and outside covers 116 and 122. Thereafter, the user sets up a washing time and operates the heater 150 to heat the washing water until a temperature of the washing water rises to a predetermined temperature. If the temperature of the washing water sensed by the temperature sensor 152 rises to the predetermined temperature, the heater 150 stops operating. Contrarily, if the temperature of the washing water in the heating tank 140 is lower than the predetermined temperature, the heater 150 is continuously operated to make the washing water rise to the predetermined temperature during the set up time in the power controller 132.

If the above operations continue by the set up time, then the heater 150 stops operating, and the user picks out the washing from the heating tank 140 and washes it a separate washing machine or a hand washing.

However, in the conventional washing machine having the boiling function, while the lower part of the heating tank is heated to a relatively high temperature, the upper part thereof is is heated to a relatively low temperature because the washing interrupts heat transfer.

That is, even if the lower part temperature of the heating tank rises to the predetermined temperature, the upper part does not. Therefore, the temperature of the washing in the upper part of the heating tank does not reach the predetermined temperature. Consequently, the conventional boiling washing machine cannot boil the washing evenly, thereby lowering the efficiency of sterilization, bleaching and washing.

Moreover, the washing efficiency of the washing floating in washing water becomes sharply lower than to the washing efficiency of the washing soaked therein. If the temperature of washing water rises, the part of the washing contacting with air is oxidized, and therefore it may be damaged.

In addition, in the conventional boiling washing machine boiling the washing is restricted according to a material of the washing, and it is difficult to boil the washing with low temperature in the case of the washing which is not allowed to wash with a high temperature, thereby lowering the washing efficiency.

Further, since there is no drain system in the heating tank, it is required to wait until washing water becomes cool, in order that a user pumps out hot washing water with user's own hands.

SUMMARY OF THE INVENTION

Accordingly, the present invention has been made keeping in mind the above-described shortcoming and user's need, and an object of the present invention is to provide a washing machine and a control method thereof, which can prevent the washing from oxidizing and improve the washing efficiency.

Another object of the present invention is to provide a washing machine and a control method thereof, which can improve the washing efficiency irrespective of a material of the washing Still another object of the present invention is to provide a washing machine and a control method thereof, which can easily supply and drain washing water.

This and other objects of the present invention may be accomplished by the provision of a washing machine comprising: a heating tank accommodating the washing and washing water; a heating part heating the washing water in the heating tank; and a circulation pump circulating the washing water in the heating tank.

Preferably, the washing machine further comprises a cabinet accommodating and supporting the heating tank, having an opening at the upper part thereof, a cover provided at the upper part of the cabinet, opening and closing the opening of the heating tank; and a controller controlling the heater to heat the washing water in the heating tank and controlling the circulation pump to circulate the washing water.

Desirably, the washing machine further comprises a control part selecting a washing course according to a washing material, and wherein the controller adjusts an operating time of the circulating pump according to the washing course selected by the control part.

Preferably, the controller controls the heating part according to the washing course selected by the control part to adjust a washing temperature, and the washing course includes a boiling course.

Preferably, the washing machine further comprises washing water circulation pipes having a washing water suction pipe communicating with one part of the heating tank, guiding the washing water from the heating tank to the circulation pump, and a washing water discharge pipe communicating with another part of the heating tank, transferring the washing water from the circulation pump to the heating tank.

Preferably, the washing water discharge pipe has at least one spray hole for spraying the washing water in the heating tank, and the washing machine further comprises a spray plate provided at the lower part of the washing water discharge pipe and having a plurality of holes for evenly supplying the washing water into the heating tank.

Preferably, the height of the washing water suction pipe is higher than the height of the heating part, and the heating part is comprised of a heater being at the below part of the heating tank.

Preferably, the washing machine further comprises a water supply pipe having a first end connected to a water supply source outside the cabinet, and a second end connected to the heating tank; and a water supply valve provided in the water supply pipe, adjusting a washing water flow in the water supply pipe.

Preferably, the washing machine further comprising a water drain pipe having a first end connected to a water drain source outside the cabinet, and a second end connected to the washing water suction pipe; and a water drain valve provided in the water drain pipe, adjusting a washing water flow in the water drain pipe, or further comprises a water drain pipe having a first end connected to a water drain source outside the cabinet, and a second end connected to the heating tank; and a water drain pump provided in the water drain pipe, draining out the washing water from the heating tank.

Preferably, outside the heating tank is provided an insulating material, and inside the cover is provided at least one pushing projection protruding inward the heating tank.

According to another aspect of the present invention, the above and other objects may be also achieved by the provision of a method for controlling a washing machine including a heater heating washing water in a heating tank, comprising the steps of supplying washing water to the heating tank; heating the washing water in the heating tank to a predetermined temperature; and circulating the washing water in the heating tank for a predetermined time.

Preferably, the method further comprises the step of draining out the washing water after circulating the washing water for the predetermined time.

Preferably, the method further comprises the step of rinsing the washing by supplying washing water again and drain out the washing water, after draining out the washing water.

Preferably, the method further comprises the steps of selecting a washing course according to a washing material; and adjusting the washing water circulating time according to the selected washing course, and the washing course includes a boiling course.

Preferably, a washing water temperature is adjusted by controlling the heater.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

A preferred embodiment of the present invention will be described in more detail with reference to the accompanying drawings.

Hereinbelow, a washing machine according to a first embodiment of the present invention will be firstly described, and then the other embodiments will be described later. In this case, it should be noted that the description about the same components may be omitted as necessary.

Figure 1:
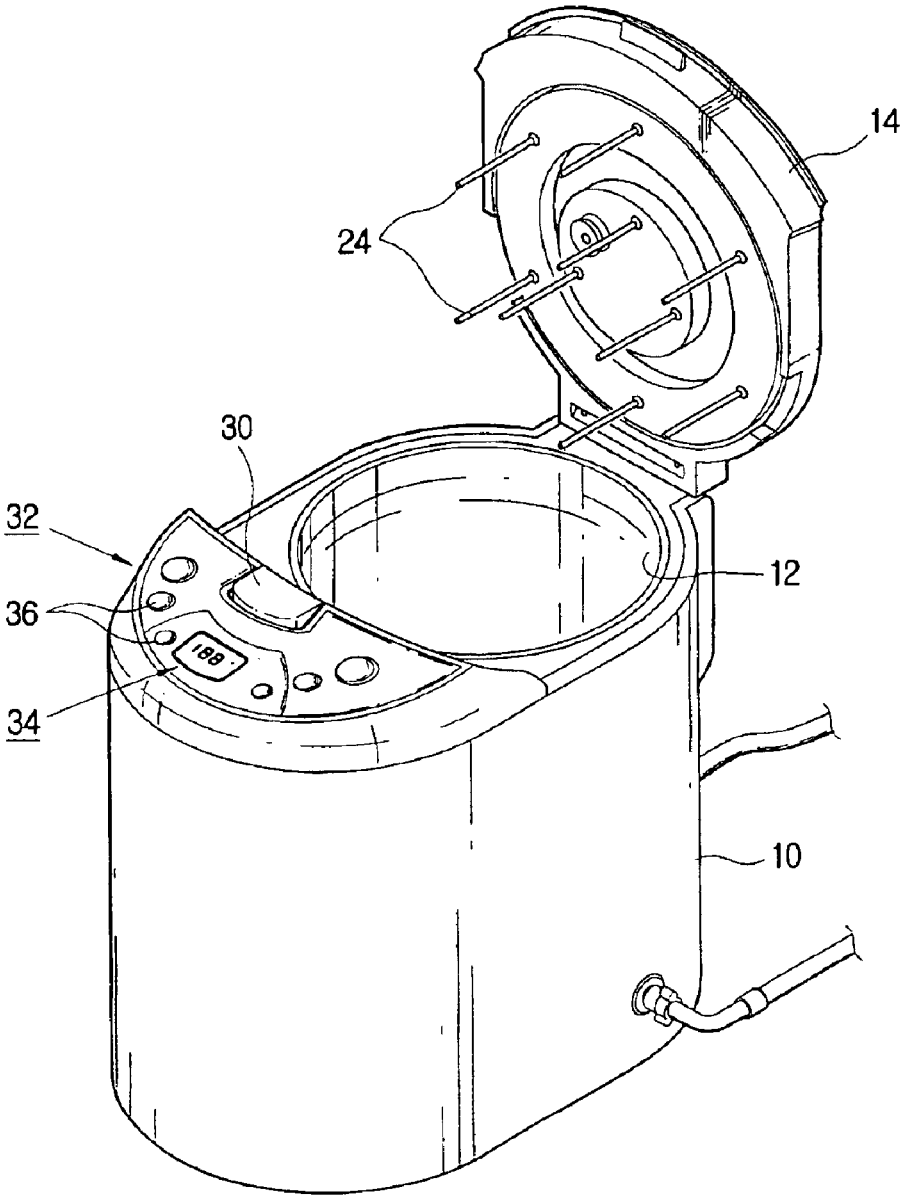
FIG. 1 is a perspective view of a washing machine according to the first embodiment of the present invention.
Figure 2:
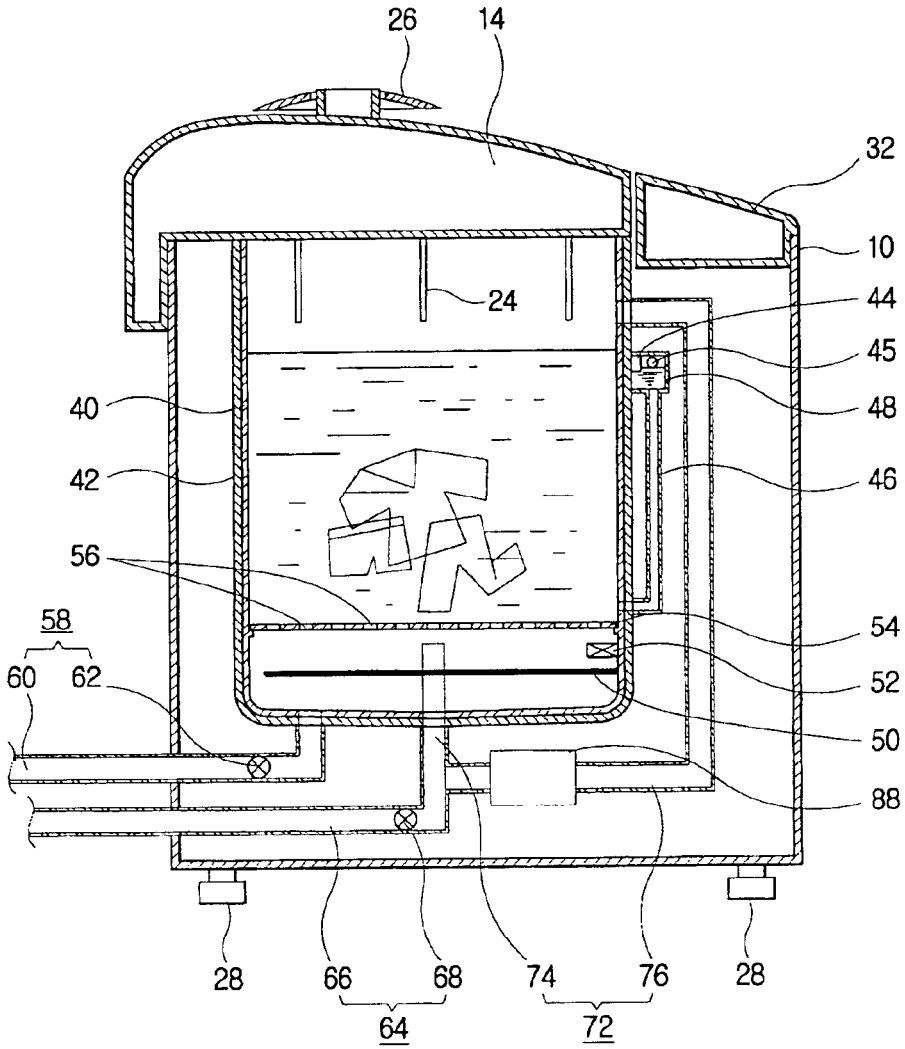
FIG. 2 is a schematic vertical sectional view of the washing machine of FIG. 1.

A washing machine according to a first embodiment of the present invention is, as shown in FIGS. 1 and 2, comprised of a cabinet 10 having a top opening 12 through which the laundry and a detergent are received; a cover 14 opening and closing the top opening 12; and a plurality of foot members 28 supporting the cabinet 10 at the bottom thereof.

Inside the cover 14 is provided a plurality of pushing projections 24 preventing the washing from floating during washing. Outside the cover 14 is provided a vapor exhaust part 26 exhausting vapor generated in washing, being communicated with a heating tank 40.

On the cabinet 10 is provided a knob 30 for opening and closing the cover 14, and a control part 32 having a plurality of selection buttons 36 for operating the washing machine. In the control part 32 is provided a display part 34 indicating washing time and the number of rinsing times.

In the cabinet 10 is provided the heating tank 40, being separated from the cabinet 10 by a predetermined distance, accommodating the washing and the detergent. The heating tank 40 is, for example, made from aluminum, iron, alloyed steel, etc. Outside the wall of the heating tank 40 is provided an insulating material 42 for a thermal insulation.

Figure 3:
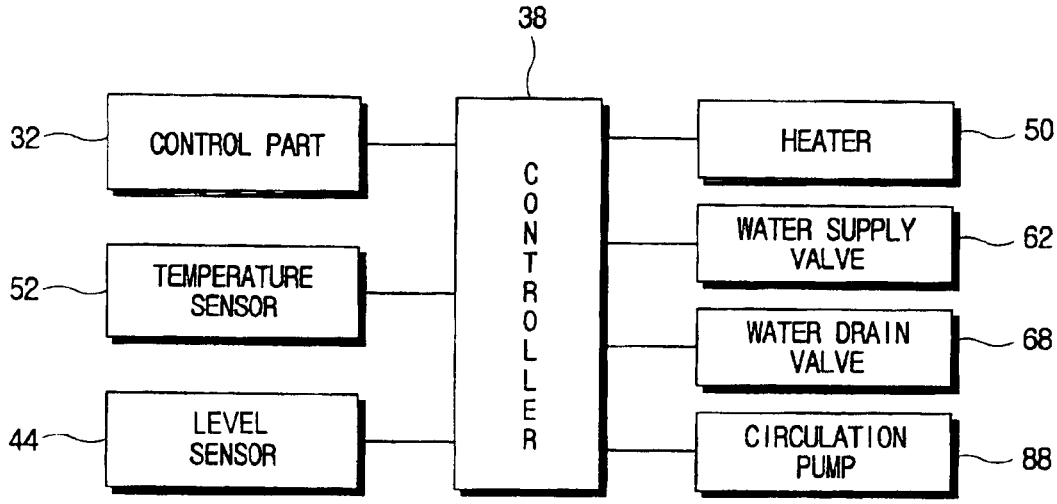
FIG. 3 is a control block diagram of the washing machine according to the first embodiment of the present invention.

On one side wall of the heating tank 40 is installed a water level sensor 44, being communicated with the heating tank 40 and sensing a level of the washing water and transmitting the sensed level signal to a controller 38 (see FIG. 3). The water level sensor 44 is adjacently installed to a floater accommodating part 48. The floater accommodating part 48 is installed on the upper end part of a water level pipe 46 which is communicated with the heating tank 40 at the lower part thereof and extended upward. Thus, some of washing water supplied into the heating tank 40 rises high along the water level pipe 46, thereby moving a floater 45 so as to actuate the water level sensor 44.

In the heating tank 40 is provided a heater 50 boiling the washing water. The heater 50 is located in the lower part of the heating tank 40. Adjacent to one part of the heater 50 is installed a temperature sensor 52 sensing a temperature of the washing water in the heating tank 40 heated by the heater 50 and transmitting a temperature signal to the controller 38. Above the heater is horizontally provided a blocking plate 54 preventing the washing in the heating tank 140 from contacting with the heater 50. The blocking plate 54 has a plurality of holes 56 through which washing water flows.

The washing machine according to the first embodiment of the present invention is further comprised of a water supply part 58 supplying washing water to the heating tank 40, a water drain part 64 draining the washing water from the heating tank 40, and a circulation pump 88 circulating the washing water in the heating tank 40. The controller 38 controls the water supply part 58, the water drain part 64, the circulation pump 88, and the heater 50 based on a signal from the control part 32.

The water supply part 58 comprises a water supply pipe 60 and a supply valve 62 being installed in the water supply pipe 60 and controlling the washing water flowing in the pipe 60 based on a signal from the controller 38. One end of the water supply pipe 60 is exposed outside and connected to a water supply source such as city water, etc., and the other end thereof is connected to the heating tank 40.

The water drain part 64 comprises a water drain pipe 66 and a drain valve 68 being installed in the water drain pipe 66 and controlling the washing water flowing in the pipe 66 based on a signal of the controller 38. One end of the water drain pipe 66 is exposed outside and connected to a water drain place such as a drain, etc., and the other end thereof is connected to from a washing water suction pipe 74.

The water supply and water drain parts 58 and 64 not only form washing water paths for supplying water to the heating tank 40 and draining water after boiling, but also form rinsing water paths rinsing the boiled washing with clean water based on a control signal of the controller 38. Further, the water supply and water drain valves 62 and 68 may be respectively connected with valve driving parts (not shown) operating based on a signal of the controller 38.

Outside of the heating tank 40 is provided a washing water circulation pipe 72 through which washing water in the heating tank 40 circulates, being communicated with the heating tank 40. In the lower part of the washing water circulation pipe 72 is installed the circulation pump 88 pumping washing water in the heating tank 40 based on a signal of the controller 38.

The washing water circulation pipe 72 is comprised of the washing water suction pipe 74 communicating with the lower part of the heating tank 40 and guiding washing water in the heating tank 40 to the circulation pump 88, and a washing water discharge pipe 76 communicating with the upper part of the heating tank 40 and transferring the washing water from the circulation pump 88 to the heating tank 40.

The washing water suction pipe 74 may have a height equal to or higher than the height of the heater 50, so that the heater 50 installed below the heating tank 40 is always soaked in the washing water, to thereby prevent the heater 50 from overheating.

The controller 38 controls the water supply valve 62 to supply washing water to the heating tank 40, and operates the heater 50 to control a washing water temperature in the heating tank 40 according to a washing course selected from the control part 32. Here, the washing course includes a boiling course. Further, the controller 38 controls an operating time of the circulation pump 88 according to the washing course selected from the control part 32 after a temperature of the washing water in the heating tank 40 reaches a predetermined temperature. Also, the controller 38 controls the water drain valve 68 to drain the washing water in the heating tank 40 through the water drain pipe 66. Then, the controller 38 and supplies washing water to the heating tank 40 again and drains it so as to rinse the washing therein.

Figure 4:
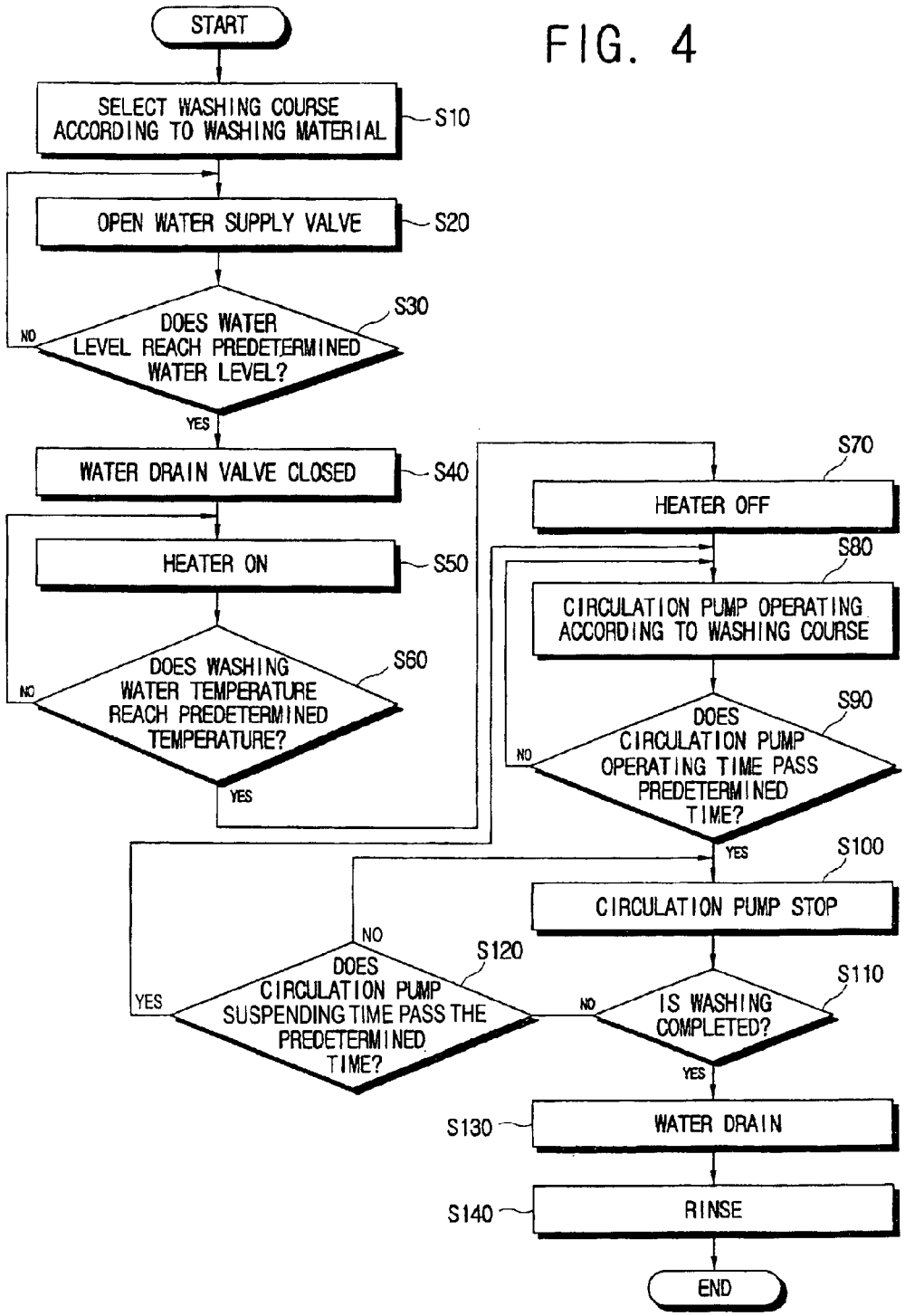
FIG. 4 is a flow chart of the washing machine according to the first embodiment of the present invention.

With this configuration, a control method for the washing machine according to the first embodiment of the present invention will be described with reference to FIGS. 3 and 4.

First, a user pushes the knob 30 and opens the cover 14, and puts the washing and a detergent in the heating tank 40 and closes the cover 14. Then, the user selects a washing course according to the washing material with the selection button 36 on the control part 32 (S10), to thereby start washing.

If a signal indicating the washing course selected from the control part 32 is inputted to the controller 38, the controller 38 transmits a driving signal to the water supply valve 62 and makes it open (S20) so as to supply washing water to the heating tank 40 through the water supply pipe 60. At this time, the water level sensor 44 located at one side wall of the heating tank 40 senses a level of the washing water passing through the water supply pipe 60 and transmits a level signal to the controller 38.

The controller 38 determines whether the water level of the heating tank 40 reaches a predetermined level, depending upon the signal from the water level sensor 44 (S30). If the water level reaches the predetermined level, the controller 38 controls the water supply valve 62 to be closed, to thereby stop the water supply (S40).

Next, the controller 38 transmits a driving signal to the heater 50 in order to operate the heater 50 and to heat the washing water in the heating tank 40 (S50). Then, the temperature sensor 52 senses the washing water temperature heated by the heater 50 and transmits a temperature signal to the controller 38. The controller 38 determines whether the washing water temperature in the heating tank 40 reaches the predetermined temperature of the washing course selected according to the washing material, in response to the signal from the temperature sensor 52 (S60). If the washing water temperature reaches the predetermined temperature, the controller 38 transmits a stop signal to the heater 50, to thereby stop the operating of the heater 50 (S70).

If the heater 50 stops operating, the controller 38 transmits a driving signal to the circulation pump 88 depending upon the course selected according to the washing material and drives the circulation pump 88 to circulate the washing water in the heating tank 40 during the predetermined time (S80). Herein, the controller 38 adjusts the operating time of the circulation pump 88. For one example, where the material has a good absorbency, the circulation pump 88 stops for a relatively long time so that the washing is sufficiently drenched. Oppositely, where the material has a poor absorbency, the circulation pump 88 stops for a relatively short time so that washing water is continuously poured on the washing. For another example, where the material requires a high temperature washing, the circulation pump 88 stops for a relatively long time so that the washing is soaked sufficiently. Oppositely, where the material requires a low temperature washing, the circulation pump 88 stops for a relatively short time so that washing water is continuously poured on the washing.

Thereafter, the controller 38 determines whether the operating time of the circulation pump 88 passes the predetermined time (S90). If it is determined that the predetermined time is passed, the controller 38 transmits the stop signal to the circulation pump so as to stop the circulation pump 88 (S100). After the circulation pump 88 stops operating, the controller 38 determines whether washing is completed (S110). If washing is not completed, the controller 38 determines whether the suspending time of the circulation pump 88 has passed the predetermined time (S120). If the predetermined time has passed, the controller 38 repeats the steps from S80 to S110. If the predetermined time has not passed, the controller 38 stops the circulation pump 88 during the predetermined time.

On the other hand, if washing is completed, the controller 38 transmits a driving signal to the water drain valve 68 so as to open the water drain valve 68 and to drain out washing water in the heating tank 40 through the water drain pipe 66 (130).

After the water drain, the controller 38 makes the water drain pipe 66 be closed by the water drain valve 68 and performs a rinsing process (S 140). That is, the controller 38 turns off the water drain valve 68 and opens the water supply pipe 60 using the water supply valve 62 in order to supply clean rinsing water to the heating tank 40. If the rising is completed, the water used in rinsing is drained out again through the water drain pipe 66. The number of rinsing times is adjustable according to the user's selection.

After the rising is completed (at this time, the water supply and water drain pipes 60 and 66 being closed by the controller 38), the user opens the cover 14 and takes out the boiled and rinsed washing from the heating tank 40. Consequently, the user can get a clean and sterilized washing.

Figure 5:
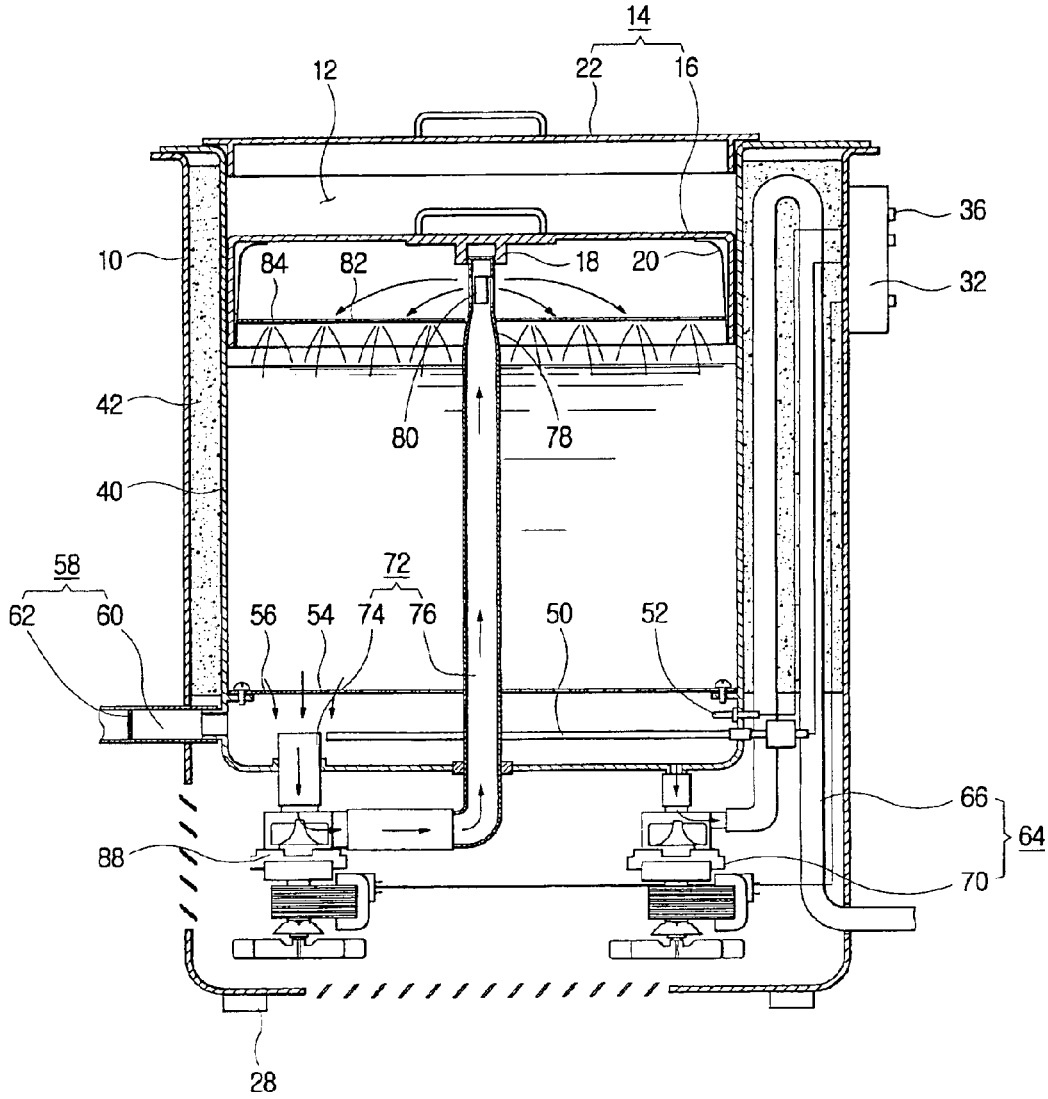
FIG. 5 is a schematic vertical sectional a washing machine according to a second embodiment of the present invention.
Figure 6:
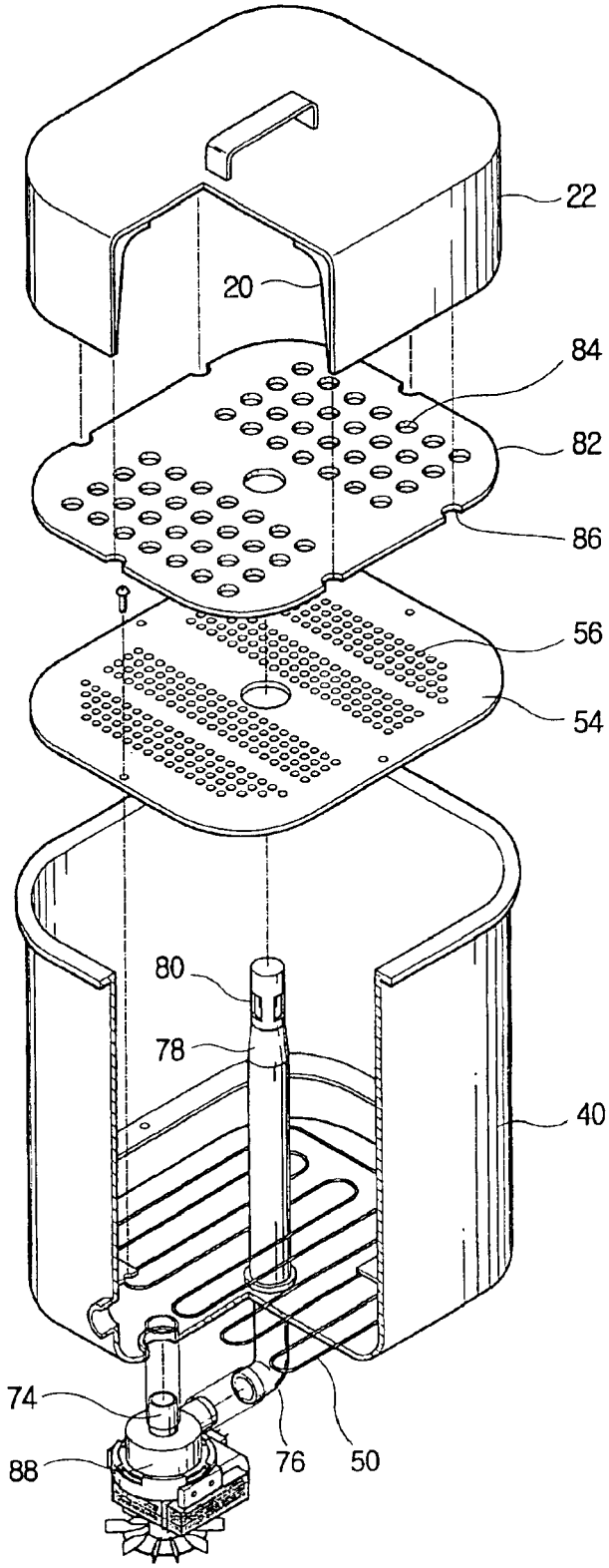
FIG. 6 is an exploded perspective view of the washing machine of FIG. 5.
Figure 7:
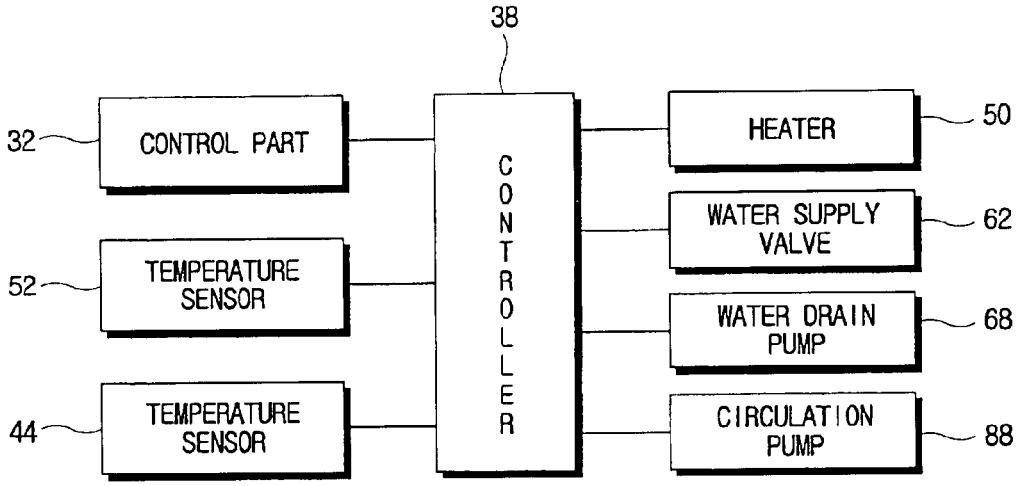
FIG. 7 is a flow chart of the washing machine according to the second embodiment of the present invention.
Figure 8:
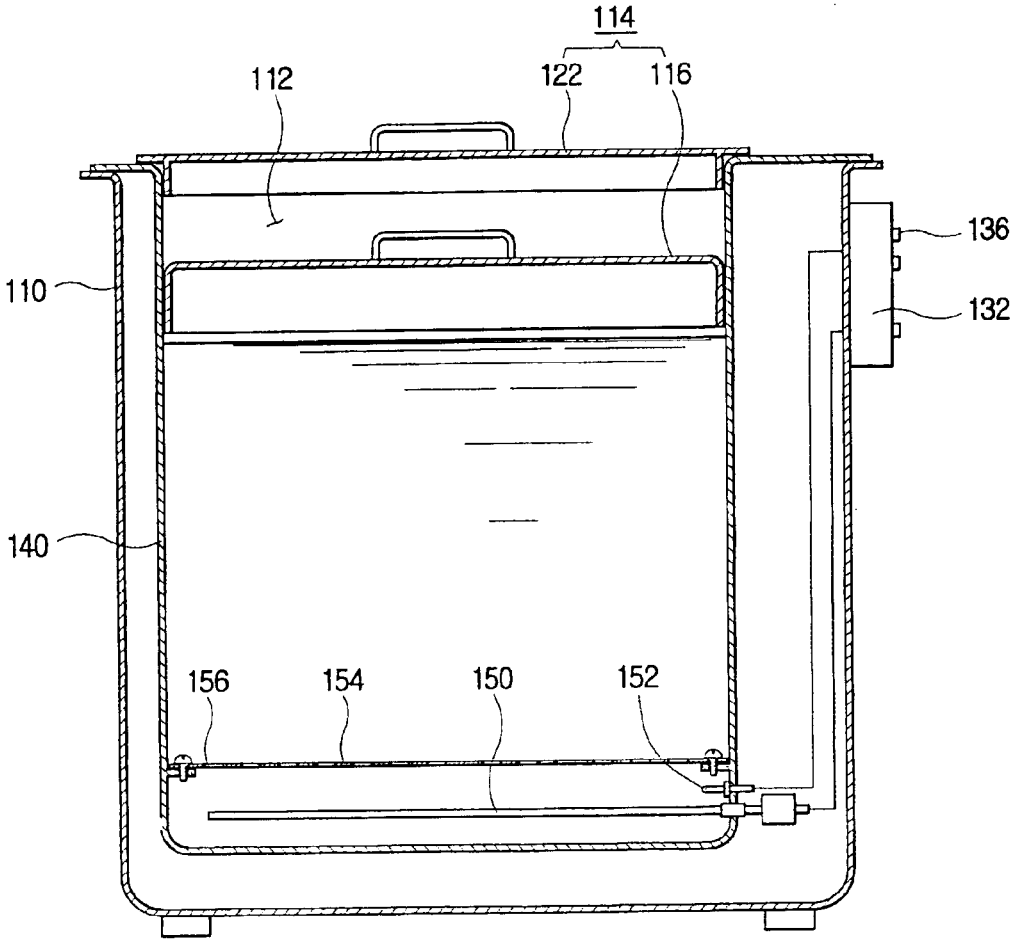
FIG. 8 (PRIOR ART)
FIG. 8 is a front plan view of a conventional boiling washing machine.

Referring to FIGS. 5 through 7, a washing machine according to a second embodiment of the present invention is comprised of a cabinet 10 having a top opening 12; a cover 14 opening and closing the top opening 12; and a plurality foot members 28 supporting the cabinet 10 at the bottom thereof.

The cover 14 comprises an inside cover 16 for covering a heating tank 40 and an outside cover 22 above the inside cover 16 opening and closing the top opening 12 of the cabinet 10. In the inner center of the inside cover 16 is provided a holder 18 accommodating and supporting a washing water discharge pipe 76. In the inner corner of the inside cover 16 are provided a plurality of ribs 20 coupling with and supporting a spray plate 82.

On the cabinet 10 are provided a control part 32 having at least one selection button 36 for manipulating the washing machine, and a display part (not shown) indicating a washing time and the number of rinsing times.

In the cabinet 10 is provided the heating tank 40, being separated from the cabinet 10 by a predetermined distance, accommodating the washing and a detergent. The heating tank 40 is, for example, made from aluminum, iron, alloyed steel, etc. Between an outside wall of the heating tank 40 and an inside wall of the cabinet 10 is provided an insulating material 42 for a thermal insulation.

On one part wall of the heating tank 40 is installed a water level sensor 44 (see FIG. 7) sensing a level of the washing water and transmitting a level signal to a controller 38 (see FIG. 7).

In the heating tank 40 is provided a heater 50 boiling the washing water. The heater 50 is disposed in the lower part of the heating tank 40. Adjacent to one end part of the heater 50 is installed a temperature sensor 52 sensing a temperature of washing water in the heating tank 40 heated by the heater 50 and transmitting a temperature signal to the controller 38. Above the heater is horizontally provided a blocking plate 54 preventing the washing in the heating tank 140 from contacting with the heater 150. The blocking plate 54 has a plurality of holes 156 through which washing water flows.

A washing machine according to the second embodiment of the present invention is further comprised of a water supply part 58 supplying washing water to the heating tank 40, a water drain part 64 draining the washing water from the heating tank 40, and a circulation pump 88 circulating the washing water in the heating tank 40. The controller 38 controls the water supply part 58, the water drain part 64, the circulation pump 88, and the heater 50 based on a signal from the control part 32.

The water supply part 58 comprises a water supply pipe 60 and a supply valve 62 being installed in the water supply pipe 60 and controlling the washing water flowing in the pipe 60 based on a signal from the controller 38. One end of the water supply pipe 60 is exposed outside and connected to a water supply source such as city water, etc., and the other end thereof is connected to the heating tank 40.

The water drain part 64 comprises a water drain pipe 66, and a drain pump 70 provided in the water drain pipe 66 draining out the washing water in the heating tank 40 based on a signal from the controller 38. One end of the water drain pipe 66 is exposed outside and connected to a water drain place such as a drain, etc., and the other end thereof is connected to the heating tank 40.

Further, the water supply valve 62 may be connected to a valve driving part (not shown) operating based on a signal of the controller 38.

The water supply and water drain parts 58 and 64 not only form a washing water paths for supplying water to the heating tank 40 and draining water after boiling, but also form a rinsing water paths rinsing the boiled washing with clean water based on a control signal of the controller 38.

Outside of the heating tank 40 is provided a washing water circulation pipe 72 through which washing water in the heating tank 40 circulates, being communicated with the heating tank 40. In the lower part of the washing water circulation pipe 72 is installed the circulation pump 88 pumping washing water in the heating tank 40 based on a signal of the controller 38.

The washing water circulation pipe 72 is comprised of the washing water suction pipe 74 communicating with the lower part of the heating tank 40 and guiding washing water in the heating tank 40 to the circulation pump 88, and a washing water discharge pipe 76 communicating with the upper part of the heating tank 40 and transferring the washing water from the circulation pump 88 to the heating tank 40.

The washing water suction pipe 74 may have a height equal to or higher than the height of the heater 50, so that the heater 50 installed below the heating tank 40 is always soaked in the washing water, to thereby prevent the heater 50 from overheating.

The washing water discharge pipe 76 being connected to the circulation pump 88 is extended from the lower part of the heating tank 40 to the upper part thereof, and accommodated in the holder 18 of the inside cover 16. The upper end part of the washing water discharge pipe 76 accommodated in the holder 18 of the inside cover 16 is clogged, and a diameter thereof is smaller than the lower part of the washing water discharge pipe 76, namely, has a tapering part 78. In the upper part of the washing water discharge pipe 76 are provided a plurality of spray holes 80 spraying and supplying washing water passing through the washing water discharge pipe 76 into the heating tank 40. At the tapering part 78 of the washing water discharge pipe 76 is coupled a spray plate 82 through which the washing water discharge pipe 76 is passed. The spray plate 82 has a plurality of holes 84 by which the washing water supplied through the washing water discharge pipe 76 is evenly sprayed. The spray plate 82 is separated from the inside cover 16 by a predetermined distance, by coupling with the tapering part 78 of the washing water discharge pipe 76.

Also, the spray plate 82 is removably installed at the inner wall face of the inside cover 16, leaving about 1 mm~2 mm. The spray plate 82 has a plurality of semicircular grooves 86 in positions corresponding to the ribs 20 of the inside cover 16. Thus, the semicircular grooves 86 accommodate the ribs 20 and are supported by the ribs 20, so as to be removably installed. Preferably, each of the holes 84 on the spray plate 82 has a diameter of about 4.0 mm~8.0 mm. In addition, it is also possible to form the spray plate 82 and the inside cover 16 in one united body.

The controller 38 controls the water supply valve 62 to supply washing water to the heating tank 40, and operates the heater 50 to control a washing water temperature in the heating tank 40 according to a washing course selected from the control part 32. Here, the washing course includes a boiling course. Further, the controller 38 controls the an operating time of the circulation pump 88 according to the washing course selected from the control part 32 after a temperature of the washing water in the heating tank 40 reaches a predetermined temperature. Also,the controller 38 controls the water drain valve 68 to drain the washing water in the heating tank 40 through the water drain pipe 66. Then, the controller 38 supplies washing water to the heating tank 40 again and drains it so as to rinse the washing therein.

With this configuration, the control method for the washing machine according to the second embodiment of the present invention will be described, while omitting the description for the same part as the first embodiment described before.

In the step of the water drain, S130, in the control method according to the second embodiment of the present invention, if washing is completed during a predetermined time, the controller 38 transmits a driving signal to the water drain pump 70 and operates the water drain pump 70, to thereby drain out washing water in the heating tank 40 through the water drain pipe 66.

After the water drain is completed, the controller 38 makes the water drain pipe 66 be closed by stopping the operation of the water drain pump 70 and performs a rinsing process (S140).

With this configuration, since the present invention provides the circulation pump circulating washing water in the heating tank, the washing in the upper part of the heating tank is always soaked, thereby preventing a washing from oxidizing, accomplishing a uniform washing, a bleaching and a sterilization, and saving washing water.

Further, the washing water temperature and the washing water circulation cycle are changed according to the washing material during washing, and it is therefore possible to improve the washing efficiency according to the washing material. That is, after heating the washing and washing water with a predetermined temperature according to the washing material, where the material has a good absorbency, the circulation pump 88 stops for a long time so that the washing is drenched sufficiently. Oppositely, where the material has a poor absorbency, the circulation pump 88 stops for a short time so that washing water is continuously poured on the washing. Also, considering temperature effect on washing, where the material requires a high temperature washing, the circulation pump 88 stops for a long time so that the washing is soaked during the very time. Oppositely, where the material requires a low temperature washing, the circulation pump 88 stops for a short time so that washing water is continuously poured enough on the washing. Moreover, the water supply part and the water drain part make it easy to supply and drain washing water.

In above-described embodiments, a heating part employs the heater soaked in the washing water, but it is also possible to install the heater in the outside to heat the heating tank. Also, the heating tank may be heated using steam or a burner.

In above-described embodiments, the foot members are not described in detail, but it may include a plurality of wheels so as to easily move the washing machine. In this case, preferably, the foot members comprise a brake unit so as to stop the washing machine in a desired location.

In above-described embodiments, after washing, a rinse process is performed. However, if a user does not want the rinse process, the user may control the selection button to make washing be completed without rinsing.

In addition, it is possible that the temperature sensor senses the temperature of washing water heated by the heater and transmits a temperature signal to the controller, to thereby alternately suspend and operate the heater.

In above-described embodiments, the water supply and the water drain are performed at the lower part of the heating tank, but the water supply may be performed at the upper part thereof.

With this configuration, the present invention provides the circulation pump circulating washing water in the heating tank, thereby preventing the washing from oxidizing, improving a washing efficiency especially improving a washing efficiency according to washing material, and saving washing water. Further, water supply and drain can be easily performed.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A method of controlling a washing machine comprising:

supplying washing water to a heating tank having an opening;

heating the washing water in the heating tank to a predetermined temperature with a heater;

arranging a cover to cover the opening of the tank, the cover having at least one projection protruding inwardly the tank to prevent an article to be washed from floating during washing; and circulating the washing water in the heating tank for a predetermined time.

2. The method according to claim 1, further comprising draining out the washing water after circulating the washing water for the predetermined time.

3. The method according to claim 2, further comprising rinsing the article to be washed by supplying washing water again and draining out the washing water, after first draining out the washing water.

4. The method according to claim 1, further comprising:

selecting a washing course according to a material of the article to be washed; and adjusting the washing water circulating time according to the selected washing course.

5. The method according to claim 4, wherein the washing course includes a boiling course.

6. The method according to claim 4, wherein a washing water temperature is adjusted by controlling the heater.

* * * * *